US007217108B2

(12) United States Patent
Herwig et al.

(10) Patent No.: US 7,217,108 B2
(45) Date of Patent: May 15, 2007

(54) PERISTALTIC HOSE PUMP

(75) Inventors: Dieter Herwig, Melsungen (DE); Reinhard Knuth, Melsungen (DE)

(73) Assignee: B. Braun Melsungen AG (DE)

( * ) Notice: Subject to any disclaimer, the term of this patent is extended or adjusted under 35 U.S.C. 154(b) by 550 days.

(21) Appl. No.: 10/613,429

(22) Filed: Jul. 3, 2003

(65) Prior Publication Data

US 2004/0037723 A1 Feb. 26, 2004

(30) Foreign Application Priority Data

Jul. 6, 2002 (DE) ..... 202 10 502 U

(51) Int. Cl.
*F04B 45/06* (2006.01)

(52) U.S. Cl. ..... 417/475; 417/474

(58) Field of Classification Search ..... 417/474, 417/477.1, 478, 475, 479; 92/168, 92, 91, 92/90

See application file for complete search history.

(56) References Cited

U.S. PATENT DOCUMENTS 4,482,347 A * 11/1984 Borsanyi ..... 604/153
4,500,266 A 2/1985 Cummins
4,690,673 A 9/1987 Bloomquist
4,755,109 A 7/1988 Botts
4,893,991 A * 1/1990 Heminway et al. ..... 417/53
5,533,886 A * 7/1996 Von Der Heyde et al. ..... 418/1
6,036,459 A * 3/2000 Robinson ..... 417/477.7

FOREIGN PATENT DOCUMENTS

| | | | |
|---|---|---|---|
| DE | 3234219 | A1 | 4/1983 |
| EP | 0 214 443 | A1 | 3/1987 |
| EP | 0 M291 158 | A1 | 11/1988 |
| EP | 0 484 717 | A1 | 5/1992 |
| GB | 1182908 | A | 3/1970 |
| GB | 2 179 404 | A | 3/1987 |

* cited by examiner

*Primary Examiner*—Michael Koczo
*Assistant Examiner*—Vikansha Dwivedi
(74) *Attorney, Agent, or Firm*—Osha Liang LLP; John W. Montgomery

(57) ABSTRACT

The hose pump comprises an eccentric drive with numerous eccentric discs (21) fastened to a shaft (20). Each eccentric disc (21) drives a crank drive (24) having a connecting rod (25). At the end of the connecting rod (25), a pump finger (11) is borne for compressing a pump hose (10). A sealing diaphragm (27) is disposed between the eccentric drive and the pump hose (10) for preventing liquid from intruding into the interior of the housing (16). The connecting rod (25) sealingly passes through the sealing diaphragm (27). The sealing diaphragm (27) comprises lateral folds (31) so that it does not exert any substantial forces upon the crank drive (24). The hose pump has a low power consumption and permits a small structure.

20 Claims, 2 Drawing Sheets

PERISTALTIC HOSE PUMP

RELATED APPLICATIONS

This application claims priority from German Utility Model Application No. 202 10 502.4, filed on Jul. 6, 2002, incorporated herein by reference for all legitimate purposes and relied upon for priority.

FIELD OF INVENTION

The invention relates to a peristaltic hose pump with a shaft comprising several eccentric discs each of which carries a bearing and thus moves a pump finger transversely to a pump hose, and with a sealing diaphragm disposed between the shaft and the pump hose.

DESCRIPTION OF RELATED ART

Peristaltic hose pumps are often used as infusion or transfusion pumps for conveying liquid substances in the medical field. Linear hose pumps are known wherein numerous pump fingers continuously and cyclically press a straight pump hose against an abutment so that the liquid in the pump hose is moved in the direction of delivery. European Patent Application 0 214 443 A1 describes a peristaltic linear hose pump with numerous eccentric discs fastened to a shaft. Each eccentric disc carries a ball bearing and acts upon a linearly movable pump finger. All the pump fingers are spanned by a sealing diaphragm forming a sealing separation between the drive mechanism and the pump hose. Thereby, damage and contaminations of the pump hose are avoided. On the other hand, the interior of the pump is protected against intruding liquid. A sealing diaphragm arranged in this manner has a negative influence upon the delivery accuracy. It causes a coupling of forces between neighboring pump fingers, whereby the consumption of electrical energy is increased as well. With the diaphragm disposed in this manner, a share of the resetting forces of the pump hose is used to deform the sealing diaphragm against the pump fingers. This may lead to a premature decrease of the resetting forces. Infusion pumps such as peristaltic hose pumps, for example, shall be built to be as small and light-weighted as possible. Therefore, it is important to reduce the requirement of energy in order to dimension components such as accumulator, power pack and drive motor as small as possible. At the same time, the demand to keep to the chosen rate of delivery has to be satisfied, even during long infusion times.

BRIEF DESCRIPTION OF THE DRAWINGS

Hereinafter, an embodiment of the invention is explained in detail with reference to the drawings, in which.

DETAILED DESCRIPTION

Figure 1:
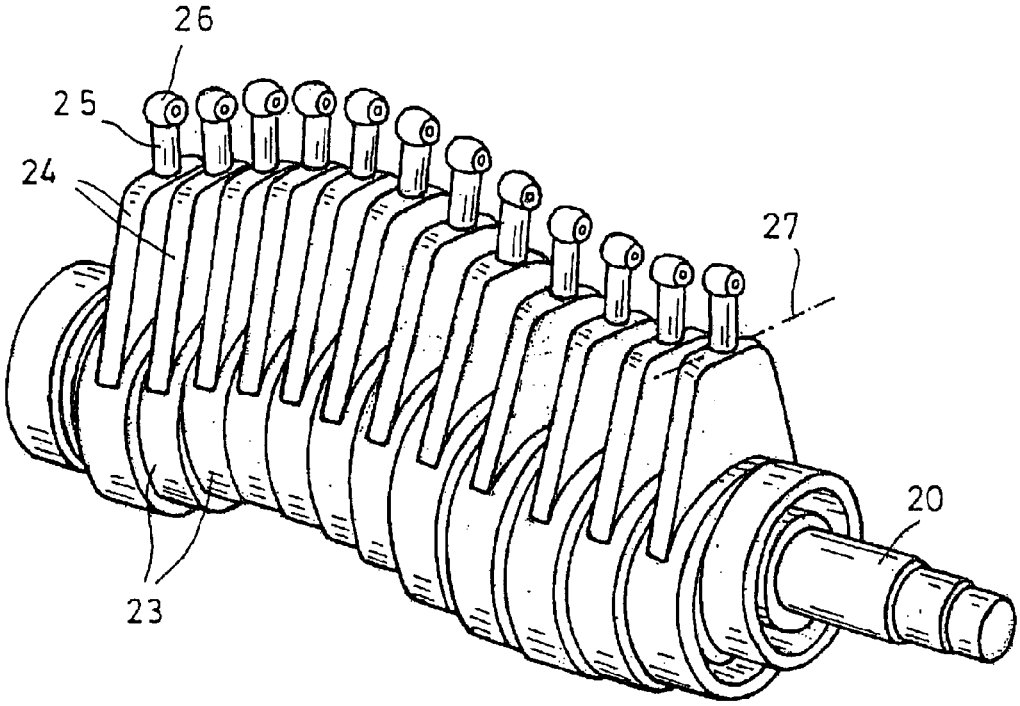
FIG. 1 shows a perspective representation of a shaft of a peristaltic pump with the eccentric discs and the connecting rods.
Figure 2:
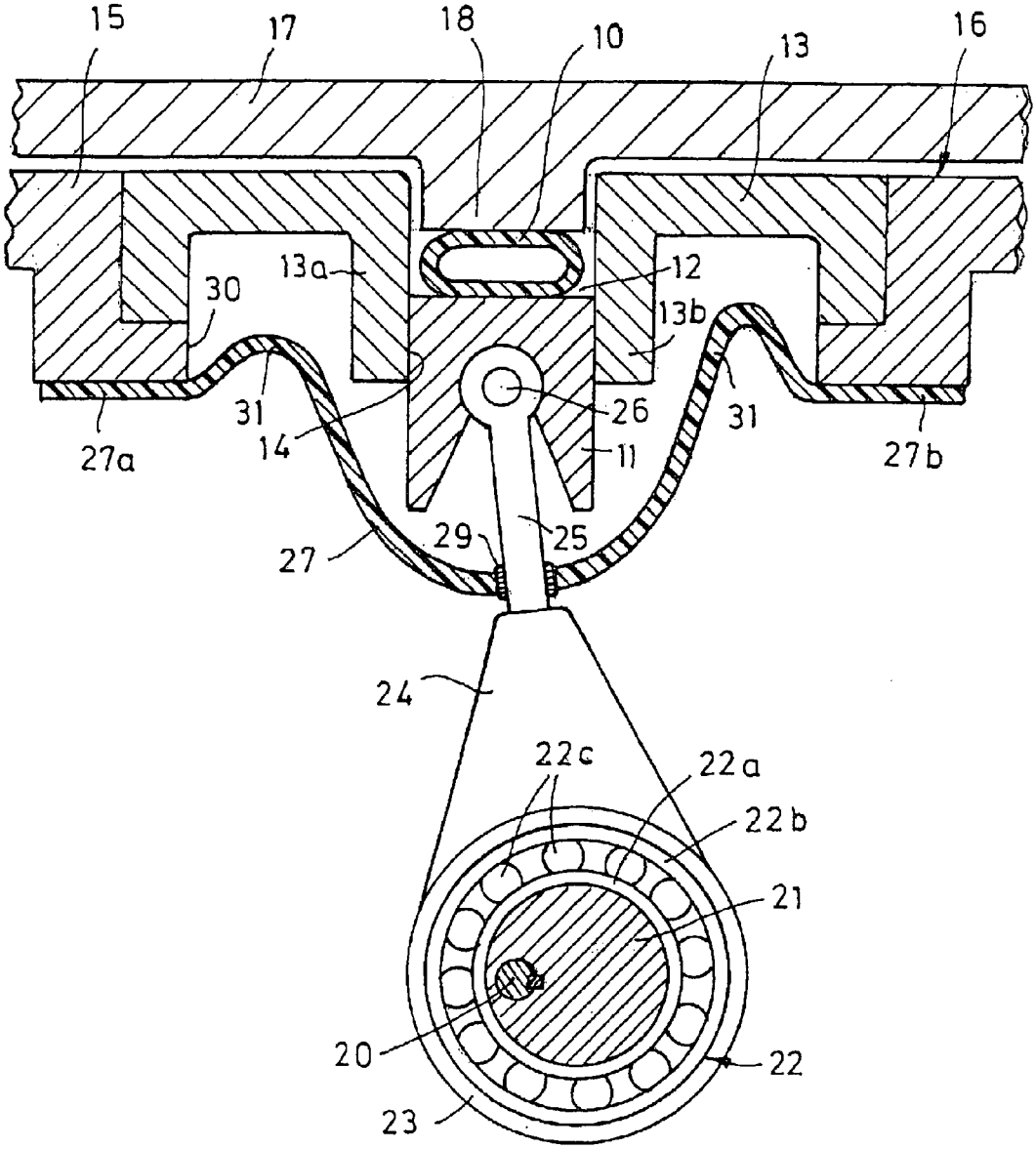
FIG. 2 shows a partial cross-section through a peristaltic hose pump.

Referring to FIGS. 1 and 2, the illustrated hose pump comprises a pump hose 10 in which the liquid to be pumped is located. This pump hose 10 is continuously periodically compressed and relieved by numerous pump fingers 11, as described in European Patent 0 214 443.

The pump hose 10 is included in a receiving channel 12 formed in a guide plate 13. The guide plate 13 has parallel walls 13*a* and 13*b* laterally defining the receiving channel 12. The receiving channel 12 is connected with several guide channels 14 in each of which a pump finger 11 is guided transversely to the hose direction. The guide plate 13 is mounted to a front wall 15 of a pump housing 16. The pump housing has a door attached in front that forms a thrust bearing 17 for supporting the pump hose 10. The thrust bearing 17 has a projection 18 projecting into the receiving channel 12.

There are about twelve pump fingers 11 altogether, which are driven by an eccentric drive in a sinusoidal manner; accordingly, the movements of neighboring pump fingers have a phase difference.

The eccentric drive of the pump fingers has a shaft 20 extending in parallel to the inserted pump hose 10. To this shaft 20, several eccentric discs 21, one for each pump finger 11, are fastened. A ball bearing 22 bearing an outer ring 23 is seated on each of the eccentric discs. The outer ring 23 is connected with a crank drive 24 comprising a connecting rod 25 projecting radially outward from the outer ring 23. A joint 26 connects the end of the connecting rod 25 with the pump finger 11. While the shaft 20 rotates at uniform speed, the described eccentric drive causes a sinusoidal reciprocating movement of the pump fingers 11 relative to the pump hose 10.

FIG. 1 shows the different positions of the connecting rods 25 in a particular rotational position of the shaft 20. The connecting rods 25 form a period of a sinusoid.

In one embodiment of the invention, the ball bearing 22 comprises an inner ring 22*a*, an outer ring 22*b*, and balls 22*c* arranged therebetween, which are included in a (non-illustrated) ball bearing retainer. In a modified embodiment, the ball bearing 22 is not provided with its own inner ring 22*a* and its own outer ring 22*b*. The inner ring is rather formed directly by the eccentric disc 21. The outer ring of the ball bearing is formed by the outer ring 23 of the crank drive 24. Preferably, plastic ball bearings are used as ball bearings.

FIG. 2 shows that between the eccentric drive and the pump fingers 11, there is a sealing diaphragm 27 extending in longitudinal direction of the receiving channel 12. The longitudinally extending edges 27*a*, 27*b* of the sealing diaphragm 27 being fastened to the rear side of the housing wall 15, so that an opening 30, defined by housing wall 15 and including the guide plate 13, is closed by the sealing diaphragm 27. The sealing diaphragm 27 comprises a sealed passage 29 for each connecting rod 25. The connecting rods 25 are cylindrical and have a round cross-section so that sealing at passage 29 can be effected in a relatively simple manner. The width of the sealing diaphragm 27 is larger than the width of the opening 30 of the housing wall 15 so that folds 31 form in the sealing diaphragm 27 toward either side of the connecting rods 25. The sealing diaphragm 27 is not taut, but forms a folded structure. The sealing diaphragm 27 prevents liquid from intruding into the interior of the housing 16. After the door that forms a thrust bearing 17 has been opened, the guide plate 13 can be removed for purposes of cleaning. Similarly, the individual pump fingers can be easily detached from the connecting rods 25.

Since the sealing diaphragm 27 exerts virtually no force upon the pump finger 11 or the connecting rod 25, the hose pump has a low power consumption. This is even furthered by the use of the ball bearing 22 that has very low friction losses.

The present invention according to the embodiment, with the features indicated in claim 1, provides a peristaltic hose pump that is adapted to be produced in a small size, has a low power consumption and a good delivery accuracy in case of long infusion times. Accordingly, each of the bearings 22 on the eccentric discs 21 of the shaft 20 is connected with a connecting rod 25 which engages on a linearly guided sealing diaphragm 27 facing the pump hose 10 and the connecting rods 25 pass through the sealing diaphragm 27.

Due to the fact that the sealing diaphragm 27 does not span the pump fingers, there is no continuous periodic stretching of the sealing diaphragm between neighboring pump fingers. Thereby, less drive energy is required. The forces for deforming the diaphragm that are still required need not be raised by the resetting forces of the pump hose but are provided by the pump drive. Thereby, the delivery rate accuracy over extended infusion times is improved. Moreover, the wear of the sealing diaphragm is reduced. The use of connecting rods permits a simple and small passage through the sealing diaphragm. The sealing diaphragm should not form a taut surface but should be a loose folded diaphragm adapting to the movements of the connecting rods without substantial material stresses occurring.

The invention prevents disturbing influences of the sealing diaphragm upon the delivery accuracy. Also, the sealing diaphragm is not fulled and not squeezed between pump fingers and pump hose.

According to a preferred embodiment of the invention, it is provided that the sealing diaphragm has folds at both sides of the pump hose, which permit an adaptation to the transverse movements of the connecting rod.

Preferably, a guide plate with a longitudinally extending receiving channel for the pump hose and with guide channels for the pump fingers is provided at the side of the pump hose. Suitably, this guide plate is removable for cleaning purposes.

A particular embodiment is constructed such that the eccentric discs 21 of the shaft 20 are integrally formed as part of the shaft so that the shaft forms a crankshaft 24. The outer jacket of the eccentric discs 21 may be formed such that it simultaneously forms the inner track 22*a* of a ball bearing 22. The connecting rods 25 may be directly formed to the outer ball bearing rings 23 that are adapted to be injection-molded as well. Due to this configuration, the number of the required components is reduced and the friction is lowered. This, in turn, is accompanied by a lower power consumption.

VARIATIONS AND EQUIVALENTS

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. For example, the eccentric discs 21 may be fastened to shaft 20 or integrally formed with shaft 20. Further, the connecting rods 25 may be fastened to the outer rings 23 of crank drive 24 or connecting rods 25 may be integrally formed with the outer rings 23. For another example, the bearings, 22 may comprise inner rings 22*a* and outer rings 22*b* or the eccentric discs 21 may form the inner ring 22*a* of bearing 22 and the outer ring 23 of the crank drive 24 may form the outer ring 22*b* of bearing 22. The bearings may be ball bearings or other friction free bearings or equivalents and may be made of plastic or other materials capable of providing the desired function as a bearing, all without departing from other aspects of the invention. It is therefore intended to include within the invention all such variations and modifications as fall within the scope of the appended claims and equivalents thereof.

Spatial references such as "bottom", "top", "front", "side", "back", "lower", "upper", "under", and "central" are for purposes of illustration only, relative to the figures shown and are not limited to the specific orientation of the structure or movement directions as described.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims.

The invention claimed is:

1. A peristaltic hose pump for pumping fluid through a pump hose, the peristaltic pump comprising:

a rotatable shaft extending parallel to the pump hose and comprising several eccentric discs each eccentric disc carrying a bearing;

a sealing diaphragm disposed between the rotatable shaft and the pump hose, and a plurality of linearly guided pump fingers each engaging a portion of the pump hose at one end and connected at another end to one of a plurality of connecting rods, wherein:

the connecting rods are rotatably engaged with the bearings on the eccentric discs to be driven transversely to the pumping hose by the eccentricity of the discs upon rotation of the shaft;

the pump fingers are arranged at the side of the sealing diaphragm facing the pump hose, and the connecting rods pass through the sealing diaphragm so that the connecting rods may move transverse to the rotation of the rotatable shaft and so that the sealing diaphragm seals the rotating shaft from the pumping hose.

2. The hose pump of claim 1, wherein the sealing diaphragm comprises lateral folds permitting an adaptation to the transverse movements of the connecting rod.

3. The hose pump of claim 1, further comprising;

a housing; and a guide plate removably mounted to the housing, the guide plate having a longitudinally extending receiving channel for the pump hose and guide channels for the plurality of linearly guided pump fingers.

4. The hose pump of claim 3, further comprising:

a thrust bearing, for supporting the pump hose, attached to the housing, the thrust bearing comprising a projection projecting into the receiving channel.

5. The hose pump of claim 1 wherein the eccentric discs of the shaft are integrally formed to the rotatable shaft.

6. The hose pump of claim 5, wherein rotatable bearings comprise rotatable ball bearings and the eccentric discs form inner races of the ball bearings.

7. The hose pump of claim 1 wherein the eccentric discs form the inner rings of ball bearings.

8. The hose pump of claim 1 wherein the connecting rod comprises an outer ring surrounding the bearing.

9. The hose pump of claim 5, wherein the connecting rod comprises an outer ring surrounding the bearing.

10. The hose pump of claim 6, wherein the connecting rod comprises an outer ring surrounding the bearing.

11. The hose pump of claim 7, wherein the connecting rod comprises an outer ring surrounding the bearing.

12. A peristaltic hose pump for moving fluid through a pump hose, the peristaltic hose pump comprising:

a rotatable shaft extending parallel to the pump hose several eccentric discs connected to the rotatable shaft for rotation therewith, a plurality of bearings, wherein each one of the plurality of bearings is carried by each one of the several eccentric discs, several linearly guided pump fingers corresponding to each one of the several bearings, a plurality of connecting rods, wherein each one of the plurality of connecting rods is connected between each one of the several linearly guided pump fingers and each one of the several bearings, so that the pump fingers are moved transversely to the pump hose upon rotation of the shaft, a sealing diaphragm disposed between the rotatable shaft and the pump hose, wherein the connecting rods sealingly pass through the sealing diaphragm and the pump fingers are arranged at one side of the sealing diaphragm facing the pump hose and the bearings are at the other side of the sealing diaphragm facing the rotatable shaft.

13. The hose pump of claim 12, wherein the sealing diaphragm comprises lateral folds permitting an adaptation to the transverse movements of the connecting rods.

14. The hose pump of claim 13, further comprising:

a housing, and a guide plate removably mounted to the housing, the guide plate having a longitudinally extending receiving channel for the pump hose and guide channels for linearly guiding the several linearly guided pump fingers.

15. The hose pump of claim 14, further comprising;

a thrust bearing attached to the housing for supporting the pump hose, the thrust bearing comprising a projection projecting into the receiving channel.

16. The hose pump of claim 12, further comprising:

a housing, and a guide plate removably mounted to the housing, the guide plate having a longitudinally extending receiving channel for the pump hose and guide channels for linearly guiding the several linearly guided pump fingers.

17. The hose pump of claim 16, further comprising;

a thrust bearing for supporting the pump hose, the thrust bearing comprising a projection projecting into the receiving channel.

18. The hose pump of claim 12, wherein the eccentric discs are integrally formed on the rotatable shaft.

19. The hose pump of claim 12, wherein bearings comprise ball bearings and the eccentric discs form the inner rings of the ball bearings.

20. The hose pump of claim 12, wherein the connecting rods each comprise an outer ring surrounding one of the bearings.

* * * * *